US006649331B2

(12) United States Patent
Arcus et al.

(10) Patent No.: US 6,649,331 B2
(45) Date of Patent: Nov. 18, 2003

(54) DEVELOPER COMPOSITION AND METHOD OF DEVELOPMENT FOR PHOTOGRAPHIC COLOR NEGATIVE FILMS

(75) Inventors: Robert A. Arcus, Penfield, NY (US); Peter N. Bacel, Spencerport, NY (US); John A. Weldy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/151,517

(22) Filed: May 20, 2002

(65) Prior Publication Data

US 2003/0082490 A1 May 1, 2003

Related U.S. Application Data

(62) Division of application No. 09/706,474, filed on Nov. 3, 2000, now abandoned.

(51) Int. Cl.[7] ..... G03C 7/407
(52) U.S. Cl. ..... 430/444
(58) Field of Search ..... 430/444

(56) References Cited

U.S. PATENT DOCUMENTS

| | | | | |
|---|---|---|---|---|
| 3,287,125 | A | 11/1966 | Green et al. | 430/250 |
| 3,778,464 | A | 12/1973 | Klemchuk | 560/171 |
| 4,500,919 | A | 2/1985 | Schreiber | 358/78 |
| 4,897,339 | A | 1/1990 | Andoh et al. | 430/372 |
| 4,906,554 | A | 3/1990 | Ishikawa et al. | 430/467 |
| 4,937,178 | A | 6/1990 | Koboshi et al. | 430/375 |
| 5,094,937 | A | 3/1992 | Morimoto | 430/485 |
| 5,110,985 | A | 5/1992 | Hayakawa et al. | 562/571 |
| 5,153,111 | A | 10/1992 | Yoshida et al. | 430/486 |
| 5,153,112 | A | 10/1992 | Yoshida et al. | 430/428 |
| 5,262,563 | A | 11/1993 | Morimoto | 562/104 |
| 5,264,330 | A | 11/1993 | Yoshida et al. | 430/486 |
| 5,267,030 | A | 11/1993 | Giorgianni et al. | 358/527 |
| 5,278,034 | A | 1/1994 | Ohki et al. | 430/440 |
| 5,344,750 | A | 9/1994 | Fujimoto et al. | 430/434 |
| 5,375,000 | A | 12/1994 | Ray et al. | 358/506 |
| 5,436,118 | A | 7/1995 | Carli et al. | 430/400 |
| 5,455,146 | A | 10/1995 | Nishikawa et al. | 430/383 |
| 5,698,379 | A | 12/1997 | Bohan et al. | 430/359 |
| 5,744,288 | A | 4/1998 | Buchanan et al. | 430/383 |
| 5,747,228 | A | 5/1998 | Bohan et al. | 430/380 |
| 5,804,356 | A | 9/1998 | Cole et al. | 430/359 |
| 5,827,635 | A | 10/1998 | Cole | 430/372 |
| 5,830,625 | A | 11/1998 | Hirano | 430/435 |
| 5,830,627 | A | 11/1998 | Nakai et al. | 430/505 |
| 5,840,470 | A | 11/1998 | Bohan et al. | 430/359 |
| 6,048,674 | A | 4/2000 | McInerney et al. | 430/383 |
| 6,200,738 | B1 | 3/2001 | Takano et al. | 430/362 |

FOREIGN PATENT DOCUMENTS

| | | |
|---|---|---|
| EP | 0 434 097 A1 | 6/1991 |
| EP | 0 800 111 A1 | 7/1991 |
| EP | 0 488 737 A1 | 6/1992 |
| EP | 0 530 921 A1 | 3/1993 |
| EP | 0 624 028 A1 | 11/1994 |
| JP | 11212227 A | 8/1999 |
| JP | 11223909 A | 8/1999 |

OTHER PUBLICATIONS

Research Disclosure, publication No. 36544, pp. 501–541, Sep. 1994, a publication of Kenneth Mason Publications Ltd., Dudley House, 12 North Street, Emsworth, Hampshire PO10 7DQ, England.

*Primary Examiner*—Hoa Van Le
(74) *Attorney, Agent, or Firm*—Nixon Peabody LLP

(57) ABSTRACT

Rapid development of silver bromoiodide color negative photographic films and formation of high quality negative images suitable for scanning to produce display images of excellent quality is made possible by a novel developer solution composition and method of development. The solution is characterized by containing, in addition to the color developer compound and conventional photographic developer solution components, a water soluble pyrrolidone polymer, a high concentration of sulfite ion and a low concentration, or the absence of, bromide ion. In the novel method the developer composition contacts the exposed film at elevated temperature, e.g., 40 to 66° C., for a short development time, e.g., 20 to 90 seconds. The developed image has image quality suitable for scanning and digital manipulation to produce a digital record for forming a color display image of high quality.

17 Claims, No Drawings

DEVELOPER COMPOSITION AND METHOD OF DEVELOPMENT FOR PHOTOGRAPHIC COLOR NEGATIVE FILMS

CROSS REFERENCE TO RELATED APLICATION

This is a Divisional of application Serial No. 09/706,474 filed Nov. 3, 2000, now abandoned.

FIELD OF THE INVENTION

This invention relates to a novel developer composition for photographic color negative films and to a method of development that provide rapid development and production of high quality color display images.

BACKGROUND OF THE INVENTION

Production of photographic color images from light sensitive silver halide materials basically consists of two processes. First, color negative images are generated by light exposure and processing of camera speed, light sensitive films, that are sometimes called "originating" elements because the images are originated therein by the film user (that is, "picture taker"). These negative images are then used to generate positive images in light sensitive materials. These latter materials are sometimes known as "display" elements and the resulting images may be known as "prints" when coated on reflective supports or "films" when coated on nonreflective supports.

The light sensitive materials are processed in automated processing machines through several steps and processing solutions to provide the display images or prints. Traditionally, this service has required a day or more. In recent years, customers have wanted faster service, and in some locations, the time to deliver this service has been reduced to within an hour. Reducing the processing time to within a few minutes is the ultimate desire. To do this, each step must be shortened.

The photographic films processed in the practice of this invention are multilayer color elements having at least two color records. Such films typically contain dye image-forming units (or color records) sensitive to each of the three primary regions of the visible spectrum. Each unit can comprise a single silver halide emulsion layer or multiple emulsion layers sensitive to a given region of the spectrum. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports. Preferably, transparent supports are employed in the films as are well known in the art. The layers of the photographic films can have known binder materials, including various types of gelatins and other colloidal materials (or mixtures thereof).

Color negative films generally have little or no silver chloride in their emulsions, and have silver bromide as the predominant silver halide. More typically, the emulsions are silver bromoiodide emulsions with silver iodide levels up to several mol percent. Such films have required these types of emulsions because emulsions containing high silver chloride have generally had insufficient light sensitivity to be used as camera speed materials although they have the advantage of being rapidly processed without major changes to the color developer solution.

To shorten the processing time, specifically the color development time, of films containing silver bromoiodide emulsions, more active color developer solutions are needed. Various attempts have been made to increase color developer activity by increasing the pH, increasing the color developing agent concentration, decreasing the halide ion concentration, or increasing temperature. However, when these changes are made, the stability of the solution and the photographic image quality are often diminished.

For example, when the development temperature is increased from the conventional 37.8° C., and the color developer solution is held (or used) in the processing tanks for extended periods of times, silver bromoiodide elements processed with such solutions often exhibit unacceptably high density in the unexposed areas of the elements, that is, unacceptably high Dmin.

U.S. Pat. No. 5,344,750 (Fujimoto et al) describes a method for processing films containing silver iodobromide emulsions that is allegedly rapid, including color development for 40–90 seconds. The potential problems of low sensitivity and high fog in rapidly developed films is asserted to be overcome by using a color development temperature and an amount of color developing agent and bromide ion in the color developer that are determined by certain mathematical relationships. That is, the amount of color developing agent and bromide ion are considered to be related, and the development temperature and bromide ion concentration are related, both relationships being expressed in mathematical equations.

It has been found, however, that even when the relationships described in U.S. Pat. No. 5,344,750 are followed and color negative films are color developed in short times (less than 90 seconds), the color balance of the three color records cannot be maintained through a useful exposure range. By "color balance" is meant the display image, produced from a neutral exposure of a color negative image, will have a neutral color rendition throughout the useful exposure range. The color record imbalance is caused by the difficulty of getting sufficient development in the red-sensitive color record next to the support without forcing the topmost blue-sensitive color record to be overdeveloped, resulting in high fog, contrast or Dmax. This color imbalance in the color records of a multilayer photographic color film cannot be corrected using conventional optical printing of the color negative onto a color display element. Thus, very short development times of the color negative films cannot readily provide negative images in the "originating" color negative film capable of providing display images having acceptable tone scale and color reproduction.

U.S. Pat. No. 5,455,146 (Nishikawa et al) describes a method for forming color images in photographic elements containing silver iodobromide emulsions that is allegedly rapid and includes color development for 30–90 seconds. The potential problems of gamma imbalance are asserted to be overcome by controlling the morphology of the light sensitive silver halide emulsion grains, the thickness and swell rate of the photographic film, and the ratio of 2-equivalent color couplers to total couplers in the red-sensitive silver halide emulsion layer. However, the methods described in this patent require a color negative film to be specifically constructed with the noted features to correct gamma imbalance, but they do not correct the color imbalance produced by rapidly developing commercially available color negative films that do not have the noted features. In other words, the method of gamma correction requires a specific film and cannot be applied to any film on the market.

Although the described processes are said to have lowered the processing times for color negative photographic films, a problem that remains is to provide a processing composition and method that will further shorten the processing time for commercially available silver bromoiodidecolor negative photographic films while producing a color image of excellent quality and avoiding the color imbalances that can occur in rapid processing of such films.

SUMMARY OF THE INVENTION

The present invention provides a novel developing solution for silver bromoiodide photographic color negative films with comprises:

(a) a color developing agent;

(b) sulfite ion in a concentration of about 0.025 to 0.25 mols per liter of solution;

(c) a water soluble pyrrolidone polymer in a concentration of about 1.0 to 10.0 grams per liter of solution; and (d) said solution having a pH in the range of about 9 to 12 and containing no bromide ion or less than about 0.06 mols of bromide ion per liter of solution.

The present invention also provides a novel method for developing an imagewise exposed silver bromoiodide photographic color negative film which comprises treating said film with the above-defined developing solution for a period of about 20 to 90 seconds at a temperature from about 40 to 66° C. The developed film is of such excellent image quality that the method of the invention further includes scanning the image and digitally manipulating the resulting density representative signals to produce a digital record providing a display image of the desired quality.

The valuable result of the practice of the invention is that photographic film is processed rapidly while obtaining color images of excellent quality and minimizing or avoiding problems encountered with prior art methods of rapid processing of color films.

DETAILED DESCRIPTION OF THE INVENTION

In accordance with the present invention, it has been discovered that a developing solution that contains, in addition to a color developer and conventional developer solution components, sulfite ion and pyrrolidone polymer in certain concentrations and that is free of bromide ion or has only a low concentration thereof, can develop exposed silver bromoiodide color negative films at elevated temperatures in very short times while producing developed images of excellent quality.

The sulfite ion component in the novel combination of components of the developing solution of the invention can be provided by including in the aqueous developing solution any of the conventional water-soluble sulfite or bisulfite salts such as sodium sulfite, sodium metabisulfite, potassium sulfite and the like. Preferred are alkali metal sulfites. The amount of sulfite salt added to the solution is chosen to provide the desired sulfite ion concentration of about 0.025 to 0.25 mols per liter of aqueous developing solution. The preferred sulfite ion concentration is from about 0.04 to 0.16 mols per liter of solution.

The pyrrolidone polymer component in the novel combination of components in the developing solution of the invention can be provided by adding to the solution any water soluble pyrrolidone polymer (which can be either a homopolymer or a copolymer) in the required concentration of about 1.0 to 10.0 grams per liter of solution. An example of such a polymer is a commercially available poly(vinyl pyrrolidone) K-15 provided by International Specialty Products Co. having a weight average molecular weight of 12,000. The preferred concentration for poly (vinyl pyrrolidone) is 1.0 to 5.0 gms per liter.

Conventional, optically-printable, color negative films exhibit a loss in color discrimination signal when processed in a very rapid developer, for example 30 seconds, instead of the conventional three minutes and 15 seconds. This is typically due to loss of signal from the lowest color record of the film pack, the red record, and in many cases, also loss of signal from the middle, green record of the film pack. Compared to the signal from color negative film photoprocessed conventionally for optical printing, in rapid processing a loss of red and green record contrast occurs, especially in the upper scale of the photographic characteristic curve and also a loss in photographic speed.

If the developed film is printed optically with high enough exposure to compensate for film speed losses, then the loss of film speed can be accommodated by adjusting the red, green, and blue light exposure of the negative image onto the color paper. However, if the film is exposed at an exposure level where any of the three layers lack sufficient sensitivity to record the image, then a full color image is not recorded and, therefore, is not recoverable, even with digital scanning and printing. It is desirable that all three color recording layers have similar sensitivity (i.e., compared to the film conventionally processed) to typical exposing illuminants such as daylight. In many cases, color correction to compensate for film speed losses is done with operator observation and operator adjustments on an image by image basis in an optical or digital minilab. Optical print systems cannot accommodate loss of film contrast but digital systems can. The composition and method of the invention minimize the losses of speeds in the three color records, especially with respect to each other. In addition, the development process minimizes the formation of unwanted development fog and keeps the maximum density signal below 3.0 for ease of digital scanning of the images. Any correction for losses in the effective film contrast due to the rapid processing can be done digitally by rapidly scanning the film and correcting color contrast and color balance in the digital image file. The processed digital image file can then be used for digital and hardcopy output to various media.

The novel process and composition obtain effectively the same photographic speed points for all three color records, blue, green and red, in a rapid (20 to 90 seconds) development of conventional color negative films and also minimize the generation of unwanted, non-image density or fog. The traditional remedy for high, unwanted fog generation in a highly active developer is not necessary for the very short development times of the method of the invention. In the method of the invention the red record speed points are recovered by developing with a novel developer formulation that has very low bromide content, and by developing at a high temperature that increases the developer activity, especially for the red and green records of the multiple layer, color negative film. No additional development accelerator chemistry or alternative color developers are required for the film or the processing compositions. The method can use the standard CD-4 developing agent so there is no hue change to the film color records or environmental issues. The resulting developed films are excellent for digital scanning. They have D-min values that are only slightly elevated and the D-max densities are under 3.0, which facilitates digital scanning.

The present invention is particularly useful for processing camera speed negative photographic films containing silver bromoiodide emulsions. Generally, the iodide ion content of such silver halide emulsions is at least 0.5 mol % and less than about 40 mol % (based on total silver), preferably from about 0.05 to about 10 mol %, and more preferably, from about 0.5 to about 6 mol %. Substantially the remainder of the silver halide is silver bromide. There can be very minor amounts of silver chloride (less than 5 mol %, and preferably less than 2 mol %).

The emulsions can be of any regular crystal morphology (such as cubic, octahedral, cubooctahedral or tabular as are known in the art) or mixtures thereof, or irregular morphology (such as multiple twinning or rounded). For tabular grains, preferably, the emulsions have an aspect ratio greater than about 5 and preferably greater than about 8. The size of the tabular grain, expressed as an equivalent circular diameter, is determined by the required speed for the applied use, but is preferably from about 0.06 to about 10 mm, and more preferably, from about 0.1 to about 5 mm.

Preferably, photographic films that are processed in accordance with the invention have at least two separate light sensitive emulsion layers, at least one being in each of two different color records. More preferably, there are three color records, each having at least one silver bromoiodide emulsion as described herein. Such films generally have a camera speed defined as an ISO speed of at least 25, preferably an ISO speed of at least 50 and more preferably, an ISO speed of at least 100.

The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27–1979 (ASA speed) and relates to the exposure levels required to enable a density of 0.15 above fog in the green light sensitive and least sensitive recording unit of a multicolor negative film. This definition conforms to the International Standards Organization (ISO) film speed rating. For the purpose of this invention, if the film gamma is substantially different from 0.65, the ISO speed is calculated by linearly amplifying or deamplifying the gamma vs. log E(exposure) curve to a value of 0.65 before determining the sensitivity.

Silver bromoiodide photographic films are exposed to radiation to form a latent image and then processed by the method of the invention to form a visible dye image. Processing includes the step of color development in the presence of a color developing agent to reduce developable silver halide and to oxidize the color developing agent. Oxidized color developing agent in turn reacts with a color-forming coupler to yield a dye.

Details of film structure and components, and methods of processing various types of films are described in *Research Disclosure*, noted below. Included within such teachings in the art is the use of various classes of cyan, yellow and magenta color couplers. In particular, the present invention can be used to process photographic elements containing pyrazolotriazole magenta dye forming couplers.

Representative color negative films that can be processed using the present invention include, but are not limited to, KODAK ROYAL GOLD® films, KODAK GOLD® films, KODAK PRO GOLD™ films, KODAK FUNTIME™ films, KODAK EKTAPRESS PLUS™ films, EASTMAN EXR™ films, KODAK ADVANTIX™ films, FUJI SUPER G Plus films, FUJI SMARTFILM™ products, FUJICOLOR NEXIA™, KONICA VX films, KONICA SRG3200 film, 3M SCOTCH® ATG films, and AGFA HDC and XRS films.

Further details of typical color negative films, their emulsions and other components are well known in the art, including *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

The color developer solution of the invention has a pH of from about 9 to about 12 (preferably from about 10 to about 11). The solution pH can be adjusted with acid or base to the desired level, and can be maintained using any suitable buffer having the appropriate acid dissociation constants, such as carbonates, phosphates, borates, tetraborates, phosphates, glycine salts, leucine salts, valine salts, proline salts, alanine salts, aminobutyric acid salts, lysine salts, guanine salts and hydroxybenzoates or any other buffer known for this purpose.

The color developer solution of the invention includes one or more color developing agents, in an amount of from about 0.01 to about 0.1 mol/l, and preferably at from about 0.017 to about 0.07 mol/l. Suitable color developing agents include those described in *Research Disclosure*, noted above. Particularly useful color developing agents include but are not limited to p-phenylenediamines (especially N,N-dialkyl-p-phenylenediamines), aminophenols, and others that are well known in the art, such as EP-A 0 434 097A1 (published Jun. 26, 1991) and EP-A 0 530 921A1 (published Mar. 10, 1993). The color developing agents can have one or more water-solubilizing groups.

Bromide ion conventionally is included in color developer solutions in an amount up to about 0.02 mol/l, and preferably from about 0.01 to about 0.15 mol/l. Bromide ion can be provided by any suitable salt such as sodium bromide, lithium bromide, potassium bromide, ammonium bromide, magnesium bromide, or calcium bromide. In the developer solution of the present invention, however, bromide ion is present in a lower concentration than in conventional developer solutions and can even be omitted. Thus, the developer solution of the invention is either free of bromide ion or contains less than about 0.030 mols of bromide per liter of solution.

Preferably, the color developer solution of the invention also includes a small amount of iodide ion from an iodide salt, such as lithium iodide, potassium iodide, sodium iodide, calcium iodide, ammonium iodide or magnesium iodide. The amount of iodide ion is generally at least about $5\times10^{-7}$ mol/l, and preferably from about $5\times10^{-7}$ to about $2\times10^{-5}$ mol/l.

The color developer can also contain any of the other components commonly found in such solutions, including but not limited to, preservatives (also known as antioxidants), metal chelating agents (also known as metal sequestering agents), antifoggants, optical brighteners, wetting agents, stain reducing agents, surfactants, defoaming agents, auxiliary developers (such as those commonly used in black-and-white development), development accelerators, and water-soluble polymers (such as a sulfonated polystyrene).

In addition to the sulfite ion which is present in the solutions of the invention, other preservatives can be present, including but not limited to, hydroxylamines, hydroxylamine derivatives, hydroxamic acid, hydrazines, hydrazides, phenols, hydroxyketones, aminoketones, saccharides, salicylic acids, alkanolamines, alpha-amino acids, polyethylineimines, and polyhydroxy compounds. Mixtures of preservatives can be used if desired. Hydroxylamine or hydroxylamine derivatives are preferred in addition to sulfites.

Antioxidants particularly useful for keeping of processing solutions of the invention for extended times at high temperature for use in rapid high temperature color development of silver bromoiodide films in the method of the invention include those disclosed by Cole et al, U.S. Pat. No. 5,804,356, incorporated herein by reference.

Optionally, but preferably, partial or total removal of silver and/or silver halide is accomplished after color development using conventional bleaching and fixing solutions (i.e., partial or complete desilvering steps), or fixing only to yield both a dye and silver image. Alternatively, all of the silver and silver halide can be left in the color developed element. One or more conventional washing, rinsing or stabilizing steps can also be used, as is known in the art. These steps are typically carried out before scanning and digital manipulation of the density representative signals.

In the method of the invention development is carried out by contacting the exposed film with the novel developing solution for about 20 to 90 seconds (preferably from about 20 to about 40 seconds, and more preferably from about 30 to about 40 seconds) at a temperature from about 40 to about 66° C. (preferably, 40 to 50° C. in suitable processing equipment, to produce the desired developed image.

The overall processing time (from development to final rinse or wash) can be from about 50 seconds to about 4 minutes. Shorter overall processing times, that is, less than about 3 minutes, are desired for processing photographic color negative films according to this invention.

Processing according to the present invention can be carried out using conventional deep tanks holding processing solutions or in automatic processing machines. Alternatively, it can be carried out with a low volume processor, one example of which is known in the art as the "low volume thin tank" processing system, or LVTT. Such processing methods and equipment are described, for example, in U.S. Pat. No. 5,436,118 (Carli et al) and publications noted therein.

Any residual error in photographic responses of photographic films that are processed in accordance with the invention, can be corrected by transforming the photographic color negative image to density representative digital signals and applying correction values to those digital signals as disclosed by Cole et al., U.S. Pat. No. 5,804,356, incorporated herein by reference. The term "correction value" refers to a broad range of mathematical operations that include, but are not limited to, mathematical constants, matrices, linear and non-linear mathematical relationships, and single and multi-dimensional look-up-tables (LUT's).

The term "density representative digital signals" refers to the electronic record produced by scanning a photographic image point-by-point, line-by-line, or frame-by-frame, and measuring the transmission of light beams, that is blue, green and red scanning beams that are modulated by the yellow, magenta and cyan dyes in the film negative. In a variant color scanning approach, the blue, green and red scanning beams are combined into a single white scanning beam that is modulated by the dyes, and is read through red, green and blue filters to create three separate digital records. Scanning can be carried out using any conventional scanning device.

The records produced by image dye modulation can then be read into any convenient memory medium (for example, an optical disk) for future digital manipulation or used immediately to produce a corrected digital record capable of producing a display image having desired aim color and tone scale reproduction. The aim color and tone scale reproduction may differ for a given photographic film image or operator. The advantage of the invention is that whatever the "aim", it can be readily achieved using the present invention.

The corrected digital signals (that is, digital records) can also be forwarded to an output device to form the display image. The output device may take a number of forms such as a silver halide film or paper writer, thermal printer, electrophotographic printer, ink jet printer, CRT display, CD disc or other types of storage and output display devices.

In one embodiment, the density representative digital signals obtained from scanning the high temperature, rapidly processed film ($R_{Ti}$, $G_{Ti}$, $B_{Ti}$) are compared with the density representative digital signals ($R_{oi}$, $G_{oi}$, $B_{oi}$) obtained from standard processing of the same film having identical exposures, and a correction factor is determined. The standard processing conditions could be those used in the commercial Process C-41 (e.g., color development for 3 minutes, 15 seconds, bromide ion level of 0.013 mol/l, color developing agent level of 0.015 mol/l, temperature of 37.8° C., and a pH of 10.0) for processing color negative films.

In its simplest form, the correction factor can be derived from two exposures that are selected to exceed the minimum exposure required to produce a density above Dmin and are less than the minimum exposure required to achieve Dmax. Preferably, these exposures are selected to be as different as possible while falling within the region that exhibits a linear density response to log exposure. Preferably, the exposures are also neutral. Based on the density representative digital signals obtained for the two exposures in both the rapidly processed, high temperature film according to this invention, and the standard temperature and time processed film, a simple gamma correction factor may be obtained.

Equations 1–3 below are used to calculate the correction factor for the red, green and blue color records respectively:

$$\Delta\gamma_R = \frac{R_{Oi_H} - R_{Oi_L}}{R_{Ti_H} - R_{Ti_L}} \quad (1)$$

$$\Delta\gamma_G = \frac{G_{Oi_H} - G_{Oi_L}}{G_{Ti_H} - G_{Ti_L}} \quad (2)$$

$$\Delta\gamma_B = \frac{B_{Oi_H} - B_{Oi_L}}{B_{Ti_H} - B_{Ti_L}} \quad (3)$$

In the above equations the subscript H and L refer to the high and low exposure levels respectively. In this approach, the density representative digital signals for the high temperature, rapidly processed negative ($R_{Ti}$, $G_{Ti}$, $B_{Ti}$) are multiplied by ($\Delta_{\gamma R}$, $\Delta_{\gamma G}$, $\Delta_{\gamma B}$) to obtain the corrected density representative signals ($R_{pi}$, $G_{pi}$, $B_{pi}$).

An improved correction factor can be obtained by comparing additional density representative digital signals over a broad range of exposures. Either a set of 3 one-dimensional look-up tables could be derived or, to achieve additional accuracy, a multidimensional look-up table could be used. In practice these approaches would use the density representative digital signal(s) ($R_{Ti}$, $G_{Ti}$, $B_{Ti}$) for each pixel of an image as an index into the look-up tables to find a new density representative signal(s) ($R_{pi}$, $G_{pi}$, $B_{pi}$) that would more closely match that set of density representative digital signals ($R_{oi}$, $G_{oi}$, $B_{oi}$) which would be achieved using a standard temperature, standard time processed negative.

Another variant of this approach would be to calculate the functional relationship between ($R_{Ti}$, $G_{Ti}$, $B_{Ti}$) and ($R_{oi}$, $G_{oi}$, $B_{oi}$) as $$f((R_{oi}, G_{oi}, B_{oi})) = g((R_{Ti}, G_{Ti}, B_{Ti}))$$

and to use this equation to calculate corrected density representative digital signals ($R_{pi}$, $G_{pi}$, $B_{pi}$) which more closely match that set of density representative digital signals ($R_{oi}$, $G_{oi}$, $B_{oi}$) which would be achieved by a standard temperature, standard time processed negative. Additional variations on this approach could include a matrix, derived by regressing the density representative digital signals achieved by the high temperature, rapidly processed negative, ($R_{Ti}$, $G_{Ti}$, $B_{Ti}$) and the desired density representative digital signals obtained from a standard temperature, standard time processed film, ($R_{oi}$, $G_{oi}$, $B_{oi}$). The matrix could also be used in combination with a set of look-up tables. The corrected density representative digital signals ($R_{pi}$, $G_{pi}$, $B_{pi}$) achieved by these approaches could then be further manipulated and/or enhanced digitally, displayed on a monitor, transmitted to a hardcopy device, or stored for use at a later date.

In another embodiment of the invention, the density representative digital signals from a high temperature, rapidly processed film ($R_{Ti}$, $G_{Ti}$, $B_{Ti}$) are obtained for a well manufactured, correctly stored and processed film exposed to a series of patches that differ in color and intensity, and are stepped in intensity over the exposure scale. These density representative digital signals are used in combination with the exposure information for the different patches to generate an interimage correction matrix ($MAT_{ii}$).

$$MAT_{ii} = \begin{vmatrix} a_1 & a_4 & a_5 \\ a_7 & a_2 & a_6 \\ a_8 & a_9 & a_3 \end{vmatrix}$$

This matrix describes the interaction between the three color records where development in one color record can influence development in one or both of the other color records. These types of interactions are well known in the photographic art and are the result of both undesired chemical interactions during development and deliberate chemical and optical interactions designed to influence the overall color reproduction of the film. The inverse of this matrix $(MAT_{ii})^{-1}$, in combination with the density representative digital signal ($R_{Ti}$, $G_{Ti}$, $B_{Ti}$) of the high temperature, rapidly processed film according to this invention, can be used to calculate a channel independent density representative digital signal ($R_{ci}$, $G_{ci}$, $B_{ci}$) (representative of those densities that would have been obtained for the particular exposure if there were no interactions between layers):

$$\begin{bmatrix} R_{Ci} \\ G_{Ci} \\ B_{Ci} \end{bmatrix} = MAT^{ii-1} \begin{bmatrix} R_{Ti} \\ G_{Ti} \\ B_{Ti} \end{bmatrix}.$$

The red, green and blue channel independent density representative digital signals ($R_{ci}$, $G_{ci}$, $B_{ci}$) are then converted to log(exposure or E) representative digital signals ($R_{LE}$, $G_{LE}$, $B_{LE}$) by the use of three one dimensional look-up tables. The recorded image is then in a form that is independent of the chemical processing.

The log(exposure) representative signals can now be processed in a variety of ways. They can be processed so as to achieve the color density representative digital signals ($R_{oi}$, $G_{oi}$, $B_{oi}$) which would have been achieved by a well manufactured, correctly stored and processed film of the same photographic film type that has been given identical exposures and processed in a standard temperature, standard time process. Alternatively, those signals can be processed to achieve the density representative digital signals that would have been obtained for an alternative photographic film type that has been given the same exposures and processed through a standard temperature and standard time process. The methods for these corrections include, but are not limited to, mathematical constants, linear and non-linear mathematical relationships, and look-up tables (LUT's).

Although after scanning the images are in the digital form, the image processing is not limited to the color and tone scale corrections described above. While the image is in this form, additional image manipulation may be used including, but not limited to, standard scene balance algorithms (to determine printing corrections based on the densities of one or more areas within the negative), sharpening via convolution or unsharp masking, red-eye reduction and grain-suppression. Moreover, the image may be artistically manipulated, zoomed, cropped, combined with additional images, or other manipulations known in the art. Once the image has been corrected and any additional image processing and manipulation has occurred, the image may be written to a variety of devices including, but not limited to, silver-halide film or paper writers, thermal printers, electrophotographic printers, ink-jet printers, display monitors, CD disks and other types of storage and display devices.

The following example is presented to illustrate, but not limit, the practice of this invention.

EXAMPLE

Materials and methods used in the example are as follows:

Film: The films used in the example were 1 inch by 12 inch strips of either Kodak Royal Gold 400 and Kodak Max 800. They have, respectively, ASA photographic speeds of 400 and 800 ASA.

Film Exposure: The films were exposed on a Kodak 1B sensitometer through a 21 step tablet that incremented the step density in units of 0.2 density from a density of 0 to a density of 4.0. The light source was a simulated daylight exposure with a color temperature of 5500 K.

Film processing: All film processing was done in deep tanks on special racks that held the films vertical in the tank. The agitation was via bursts of nitrogen bubbles for two seconds, every six seconds, in the development tank. All other tanks had vigorous and continuous air bubble agitation, except for the final rinse, which had no agitation.

The film processing steps are listed in the Table 1 below. The cross over time between all tanks is 10 seconds for the C-41 development and 5 seconds for the rapid development. For example, in the C-41 development, the film would be 185 seconds in the tank, followed by 10 seconds out of the tank solution, which includes drain time and positioning time, prior to dropping the film into the bleach tank precisely 195 seconds after the film was dropped into the development tank. In the rapid process, i.e., the process of the invention, the time is 25 seconds in the development tank, followed by a 5 second drain and position time prior to dropping into the bleach tank precisely at 30 seconds after the initial drop into the development tank.

TABLE 1

| Process step | Process times for C-41 development | Process times for Rapid Development (the invention) |
|---|---|---|
| development | 195 sec. | 30 sec. |
| bleach | 45 sec. | 45 sec. |
| water wash | 30 sec. | 30 sec. |
| fixer | 90 sec. | 90 sec. |
| wash | 30 sec. | 30 sec. |
| Photoflo rinse | 60 sec. | 60 sec. |

The compositions of the developers for the example are shown in Table 2 below. All numbers are concentrations in mols per liter of final solution except for poly (vinylpyrrolidone) which is in grams per liter. The pH of the one liter solution was adjusted to the aim pH with potassium hydroxide or sulfuric acid at 24 C.

TABLE 2

| | C-41 Formula mol/L | Invention Formula A mol/L | Invention Formula B mol/L | Invention Formula C mol/L | Invention Formula D mol/L |
|---|---|---|---|---|---|
| hydroxylamine sulfate | 0.012 | 0.018 | 0.018 | 0.018 | 0.018 |
| diethylenetriamine pentaacetic acid, sodium salt | 0.005 | 0.005 | 0.005 | 0.005 | 0.005 |
| potassium iodide ($\times 10^{-6}$) | 7.229 | 1.205 | 1.205 | 1.205 | 1.205 |
| poly (vinylpyrrolidone) (g/L) | | 3.000 | 3.000 | 3.000 | 3.000 |
| sodium bromide | 0.013 | 0.0078 | 0.0243 | 0.0466 | 0.0661 |
| potassium carbonate | 0.271 | 0.289 | 0.289 | 0.289 | 0.289 |
| 4-(N-Ethyl-N-2-hydroxyethyl)-2-methylphenylenediamine sulfate | 0.015 | 0.051 | 0.051 | 0.051 | 0.051 |
| potassium sulfite | | 0.084 | 0.084 | 0.084 | 0.084 |
| sodium sulfite | 0.032 | | | | |
| adjusted pH | 10.07 | 10.48 | 10.48 | 10.48 | 10.48 |

In the above listed compositions formula A is 0.0078 molar in bromide ion, formula B is 0.024 molar in bromide ion, formula C is 0.046 molar in bromide ion, and formula D is 0.066 molar in bromide ion.

The composition of the C-41 RA bleach is in Table 3 below. All numbers are reported in grams per liter of final solution. The pH of the one liter solution was adjusted to the aim pH with ammonium hydroxide or sulfuric acid at 24 C.

TABLE 3

| | |
|---|---|
| Propylene diamine tetraacetic acid | 113.6 |
| Kodak anti-cal 3 | 0.953 |
| glacial acetic acid | 51.49 |
| ammonium bromide | 94.67 |
| ferric nitrate nonahydrate | 136.93 |
| pH adjusted to a value of | 4.5 |

The composition of the C-41 RA fixer is in Table 4 below. All numbers are reported in grams per liter of final solution. The pH of the one liter solution was adjusted to the aim pH with ammonium hydroxide or sulfuric acid at 24 C.

TABLE 4

| | |
|---|---|
| ammonium thiosulfate | 112.85 |
| ammonium sulfite | 7.99 |
| sodium sulfite | 14.00 |
| ammonium thiocyanate | 90.00 |
| EDTA, dihyrated sodium salt | 1.20 |
| glacial acetic acid | 0.77 |
| pH adjusted to a value of | 6.20 |

Kodak Royal Gold 400 film was processed with the four developer compositions of the invention, Formula A, Formula B, Formula C, and Formula D, at four different temperatures. The developers differed in the mols of bromide per liter of solution as shown in Table 2. The film was processed at the following four different temperatures: 43.4, 49, 54.6, and 60.2 C. Table 5 shows the results in terms of D-min and D-max densities, of variations in two factors, the temperature and the bromide level, and four levels for each factor.

TABLE 5

| temp C/Br | Developer Formula A 0.0078 | Developer Formula B 0.0243 | Developer Formula C 0.0466 | Developer Formula D 0.0661 | Developer Formula A | Developer Formula B | Developer Formula C | Developer Formula D |
|---|---|---|---|---|---|---|---|---|
| | Red Record D-min | | | | Red Record D-max | | | |
| 43.4 | 0.208 | 0.235 | 0.234 | 0.21 | 0.668 | 0.576 | 0.487 | 0.42 |
| 49 | 0.255 | 0.248 | 0.246 | 0.221 | 1.003 | 0.837 | 0.727 | 0.658 |
| 54.6 | 0.352 | 0.305 | 0.277 | 0.258 | 1.282 | 1.104 | 1.01 | 0.95 |
| 60.2 | 0.496 | 0.441 | 0.378 | 0.326 | 1.7 | 1.589 | 1.43 | 1.33 |
| | Green Record D-min | | | | Green Record D-max | | | |
| 43.4 | 0.745 | 0.795 | 0.795 | 0.737 | 1.248 | 1.174 | 1.069 | 0.956 |
| 49 | 0.776 | 0.792 | 0.79 | 0.734 | 1.655 | 1.508 | 1.373 | 1.245 |
| 54.6 | 0.877 | 0.826 | 0.807 | 0.758 | 2.112 | 1.922 | 1.808 | 1.706 |
| 60.2 | 1.169 | 0.977 | 0.864 | 0.803 | 2.763 | 2.66 | 2.484 | 2.325 |
| | Blue Record D-min | | | | Blue Record D-max | | | |
| 43.4 | 1.033 | 1.078 | 1.08 | 1.029 | 2.135 | 1.904 | 1.696 | 1.537 |
| 49 | 1.135 | 1.073 | 1.068 | 1.021 | 2.629 | 2.38 | 2.137 | 1.92 |
| 54.6 | 1.437 | 1.184 | 1.099 | 1.045 | 3.084 | 2.852 | 2.66 | 2.484 |
| 60.2 | 1.894 | 1.539 | 1.271 | 1.145 | 3.471 | 3.455 | 3.236 | 3.106 |

Both the D-min tables and the D-max tables in Table 5 show that the density values increase along a diagonal from the upper right corner, which is high bromide ion at low temperature, to the bottom left, which is low bromide level at high temperature. The blue record D-min value for 0.0078 mols/liter of bromide at 60.2 C is greater than desired, i.e., 1.3. The blue record D-max responses for all of the developers at 60.2 C and for Formula a at 54.6 C are above density value of 3.0. This introduces significant noise in the digital scanning process. However, in each instance, suitable densities can be achieved by employing a developer solution within the scope of the invention and correlating its composition with the rapid processing conditions of time and temperature within the scope of the invention. In preferred embodiments of the invention the bromide concentration of the developing solution and the development temperature are correlated to produce a developed film having a blue record maximum density less than about 3.0 and a minimum density below about 1.3.

The results for the red record contrasts (as determined by best fit slope calculations) for processing the film as described above are shown below in Table 6.

TABLE 6

| temp C/Br | Developer Formula A 0.0078 | Developer Formula B 0.0243 | Developer Formula C 0.0466 | Developer Formula D 0.0661 |
|---|---|---|---|---|
| | Red Record Contrast | | | |
| 43.4 | 0.138 | 0.089 | 0.059 | 0.046 |
| 49 | 0.265 | 0.196 | 0.156 | 0.141 |
| 54.6 | | 0.293 | 0.262 | 0.246 |
| 60.2 | | | | |
| | Green Record Contrast | | | |
| 43.4 | 0.032 | 0.102 | 0.067 | 0.049 |
| 49 | 0.314 | 0.234 | 0.177 | 0.154 |
| 54.6 | | 0.388 | 0.338 | 0.31 |
| 60.2 | | | | |
| | Blue record contrast | | | |
| 43.4 | 0.341 | 0.228 | 0.154 | 0.115 |
| 49 | 0.51 | 0.408 | 0.321 | 0.272 |

TABLE 6-continued

| temp C/Br | Developer Formula A 0.0078 | Developer Formula B 0.0243 | Developer Formula C 0.0466 | Developer Formula D 0.0661 |
|---|---|---|---|---|
| 54.6 | | 0.573 | 0.516 | 0.471 |
| 60.2 | | | | |

Table 6 shows that the red contrast value decreases as the amount of bromide in the developer increases and the temperature decreases. A suitable contrast is 1.7 or above. The test results show that at 43.4° C. red contrast is too low with all of the developers and also too low for Formula C and Formula D developers at 49° C. The blue and green record contrasts show that for the high bromide solution (Formula D) development at 54.6 C, gives significantly lower contrast than the Developer B formulation at the same temperature.

Further demonstration of the affect of development temperature and bromide concentration is shown in Table 6A, which lists the speed for each developed color record at a point on the characteristic curve that is 0.15 above D-min.

TABLE 6A

| Temp C\Br | Developer Formula A 0.8 | Developer Formula B 2.53 | Developer Formula C 4.8 | Developer Formula D 6.8 |
|---|---|---|---|---|
| | Red record Best Fit Slope | | | |
| 43.4 | 337.5 | 327.1 | 320.3 | 317.2 |
| 49 | 345.8 | 342.1 | 330.9 | 320.3 |
| 54.6 | | 354.4 | 350.9 | 341.7 |
| 60.2 | | | | |
| | Green record Best Fit Slope | | | |
| 43.4 | 335.1 | 325 | 314.5 | 299.6 |
| 49 | 356.6 | 341.5 | 330.6 | 321.2 |
| 54.6 | | 358.7 | 346 | 336.4 |
| 60.2 | | | | |
| | Blue record Best Fit Slope | | | |
| 43.4 | 349.9 | 330.9 | 321.6 | 317.7 |
| 49 | 356.1 | 351.6 | 335.7 | 329.1 |
| 54.6 | | 361 | 353.7 | 344.4 |
| 60.2 | | | | |

Again, these results show that closely matching speeds for each record can be achieved in rapid processing in accordance with the invention by correlating the development temperature and the bromide concentration. In fact, it is an aim of this effort to maximize the red record speed value while maintaining other photographic values within useful limits.

TABLE 7

Summary of above photographic response data

| Developer | NaBr gm/liter | Bromide Molarity | Temp. C. | | |
|---|---|---|---|---|---|
| A | 0.8 | 0.0078 | 43.4 | Red contrast too low | Comparison |
| A | 0.8 | 0.0078 | 49 | | INVENTION |
| A | 0.8 | 0.0078 | 54.6 | Blue D-min and D-max too high | Comparison |
| A | 0.8 | 0.0078 | 60.2 | Blue D-min and D-max too high | Comparison |
| B | 2.5 | 0.0243 | 43.4 | Red contrast too low | Comparison |
| B | 2.5 | 0.0243 | 49 | | INVENTION |
| B | 2.5 | 0.0243 | 54.6 | | INVENTION |
| B | 2.5 | 0.0243 | 60.2 | Blue D-min and D-max too high | Comparison |
| C | 4.8 | 0.0466 | 43.4 | Red contrast too low | Comparison |
| C | 4.8 | 0.0466 | 49 | Red contrast too low | Comparison |
| C | 4.8 | 0.0466 | 54.6 | | INVENTION |
| C | 4.8 | 0.0466 | 60.2 | Blue D-min and D-max too high | Comparison |
| D | 6.8 | 0.0661 | 43.4 | Red contrast too low | Comparison |
| D | 6.8 | 0.0661 | 49 | Red contrast too low | Comparison |
| D | 6.8 | 0.0661 | 54.6 | Green and Blue speed too slow | Comparison |
| D | 6.8 | 0.0661 | 60.2 | Blue D-min and D-max too high | Comparison |

The results demonstrate that the composition and method of the invention overcome the problem of low photographic speed in the red record that can occur in rapid development of a three record color negative film. This is done without incorporation of chemistry in the film such as blocked color developer or blocked/complexed electron transfer agents (ETAs) or precusors to ETAs. Furthermore, the standard CD-4 p-phenylenediamine developing agent can be used so there is no hue change to the film color records or environmental problems. Conventional films processed in accordance with the invention are excellent for digital scanning when processed with the novel developer solution for 30 sec. They have D-min values that are only slightly elevated and the D-max densities are under 3.0, which facilitates digital scanning.

The following illustrates a useful mathematical correlation of the processing conditions with the developer solution composition. The equations define parallelograms of satisfactory images in the D/Log E plot that show correlation of temperature with bromide concentration.

For combination with high levels of sulfite, the following can be used:

For 0.0<[Br molarity]<0.06, the following equation describes the space at 30 seconds processing time. Similar areas are applicable for processing times from 20 to 39 seconds.

$$\text{Temperature C}=(143\times[\text{Br molarity}]+48)+/-5$$

In terms of [Br] molarity, 0.000<[Br]<0.060

This is equivalent to grams of NaBr per liter of developer of, $$0.0<\text{gm of NaBr/liter}<6.2$$

In terms of processing temperature, 43<processing temp C<65

In terms of processing time in developer, 20<processing time in seconds<39

To recast this in terms of an equation that defines a parallelogram area of selection, the temperature can be defined in terms of a range of bromide concentrations, as follows:

For 0.00<[Br molarity]<0.06, the following equation describes the space at 30 seconds processing time:

$$\text{Temperature C}=(190\times[\text{Br molarity}]+49)+/-5$$

Similar areas would be applicable for processing times from 20 to 39 seconds.

The invention has been described in detail with particular reference to preferred embodiments thereof, but it will be understood that variations and modifications can be effected within the spirit and scope of the invention.

We claim:

1. A method for developing an imagewise exposed silver bromoiodide color negative photographic film, which comprises contacting said film for a time period of about 20 seconds to 90 seconds at a temperature from about 40° C. to 66° C. with a developing solution resulting in a developed film, wherein said developing solution comprises:

(a) a color developing agent;

(b) sulfite ion in a concentration from about 0.025 mols per liter of solution to 0.25 mols per liter of solution;

(c) a water soluble pyrrolidone polymer in a concentration from about 1.0 grams per liter of solution to 10.0 grams per liter of solution; and (d) said developing solution having a pH from about 9 to about 12 and being free of a bromide ion concentration or containing no more than about 0.06 mols of bromide ion concentration per liter of solution.

2. The method of claim 1, wherein said color developing agent is a p-phenylene diamine.

3. The method of claim 1, wherein said time period, said temperature and said bromide ion concentration are correlated to produce a developed film having in its blue record a maximum density less than about 3.0 and a minimum density below about 1.3.

4. The method of claim 1, wherein said pyrrolidone polymer is poly(vinylpyrrolidone) in a concentration from about 1.0 grams per liter of solution to 5.0 grams per liter of solution.

5. The method of claim 1, which further comprises (a) scanning said developed film to form density representative signals for at least two color records of the film, and (b) digitally manipulating said density representative signals to correct either or both interactions and gamma mismatches in said color records to produce a digital record providing a display image having desired aim color and tone scale reproduction.

6. The method of claim 1, wherein said pH range is from about 10 to about 12.

7. The method of claim 1, wherein said pH range is maintained with a buffer solution selected from the group consisting of carbonates, phosphates, borates, tetraborates, glycine salts, leucine salts, valine salts, proline salts, alanine salts, aminobutyric acid saits, lysine salts, guanine salts, and hydroxybenzoates.

8. The method of claim 1, wherein said color developing agent is selected from the group consisting of p-phenylene diamine(s) and aminophenol(s).

9. The method of claim 1, wherein said sulfite ion concentration is derived from a water soluble sulfite ion component selected from the group consisting of sodium sulfite, sodium metabisulfite, and potassium sulfite.

10. The method of claim 1, wherein said sulfite ion concentration is 0.084 mols per liter of solution.

11. The method of claim 1, wherein said sulfite ion concentration is from about 0.04 mols per liter of solution to about 0.16 mols per liter of solution.

12. The method of claim 1, wherein said pyrrolidone polymer is a homopolymer or a copolymer.

13. The method of claim 1, wherein said pyrrolidone polymer is poly(vinylpyrrolidone) in a concentration from about 1.0 grams per liter of solution to 5.0 grams per liter of solution.

14. The method of claim 1, wherein said developing solution includes other components selected from the group consisting of antioxidants, preservatives, metal chelating agents, metal sequestering agents, antifoggants, optical brighteners, wetting agents, stain reducing agents, surfactants, defoaming agents, auxiliary developers, development accelerators, and water-soluble polymers.

15. The method of claim 1, wherein said temperature is from about 40° C. to 50° C.

16. The method of claim 1, wherein said developing solution having no more than about 0.06 mols of bromide ion per liter of solution.

17. The method of claim 1, wherein said temperature is defined in terms of an equation of formula:

$$\text{Temperature}(^\circ C.)=(190\times[Br\ \text{Molarity}]+49)+/-5$$

wherein said developing solution being free of bromide ion or containing no more than about 0.06 mols of bromide ion per liter of solution.

* * * * *